US012564214B2

(12) United States Patent
Lisan et al.

(10) Patent No.: US 12,564,214 B2
(45) Date of Patent: Mar. 3, 2026

(54) TOBACCO SMOKE FILTER AND METHOD OF PRODUCTION

(71) Applicant: FILTRONA PTE. LTD., Singapore (SG)

(72) Inventors: Ahmad Fashihul Lisan, Sidoarjo (ID); Sudirman Widiarto, Sidoarjo (ID); Lee Philip O'Donovan, Jarrow (GB)

(73) Assignee: Filtrona Pte. Ltd., Singapore (SG)

( * ) Notice: Subject to any disclaimer, the term of this patent is extended or adjusted under 35 U.S.C. 154(b) by 508 days.

(21) Appl. No.: 18/340,105

(22) Filed: Jun. 23, 2023

(65) Prior Publication Data

US 2023/0329328 A1 Oct. 19, 2023

Related U.S. Application Data

(62) Division of application No. 14/131,293, filed as application No. PCT/GB2012/000571 on Jul. 4, 2012, now abandoned.

(30) Foreign Application Priority Data

| | | |
|---|---|---|
| Jul. 7, 2011 | (GB) | 1111678 |
| Oct. 7, 2011 | (GB) | 1117418 |
| Nov. 1, 2011 | (GB) | 1118891 |

(51) Int. Cl.

| | |
|---|---|
| ***A24D 3/04*** | (2006.01) |
| ***A24D 3/00*** | (2020.01) |
| ***A24D 3/02*** | (2006.01) |

(52) U.S. Cl.

CPC ..... *A24D 3/04* (2013.01); *A24D 3/00* (2013.01); *A24D 3/0233* (2013.01); *A24D 3/025* (2013.01); *A24D 3/0275* (2013.01); *A24D 3/048* (2013.01)

(58) Field of Classification Search

None

See application file for complete search history.

(56) References Cited

U.S. PATENT DOCUMENTS

| | | | |
|---|---|---|---|
| 2,747,579 | A | 5/1956 | Gage et al. |
| 3,377,220 | A | 4/1968 | Berger et al. |
| 3,424,172 | A | 1/1969 | Neurath et al. |

(Continued)

FOREIGN PATENT DOCUMENTS

| | | |
|---|---|---|
| EP | 0466114 A2 | 1/1992 |
| GB | 1169932 | 11/1969 |

(Continued)

OTHER PUBLICATIONS

International Search Report issued in International Application No. PCT/GB2012/000571, date of mailing Nov. 19, 2012 (5 pages).

(Continued)

*Primary Examiner* — Michael J Felton

(74) *Attorney, Agent, or Firm* — FLYNN THIEL, P.C.

(57) ABSTRACT

A method of producing a flavoured tobacco smoke filter or filter element comprising a self-sustaining longitudinally extending cylindrical core comprising fibres or filaments of tobacco smoke filtering material which are bonded at their points of contact; the method comprising a step of applying a flavouring agent to a longitudinally advancing flow of filters and/or filter elements and/or multiple filter rods. Filters and filter elements are also provided.

16 Claims, 2 Drawing Sheets

(56) References Cited

U.S. PATENT DOCUMENTS

| | | | | |
|---|---|---|---|---|
| 3,455,766 | A | 7/1969 | Berger et al. | |
| 3,552,400 | A | 1/1971 | Berger et al. | |
| 4,281,671 | A * | 8/1981 | Bynre | A24D 3/0212 428/375 |
| 2008/0029118 | A1 * | 2/2008 | Nelson | A24D 3/0229 131/365 |

FOREIGN PATENT DOCUMENTS

| | | | |
|---|---|---|---|
| WO | 03/085185 | A2 | 10/2003 |
| WO | 2011/058319 | A1 | 5/2011 |

OTHER PUBLICATIONS

Written Opinion of the International Searching Authority issued in International Application No. PCT/GB2012/000571, date of mailing Nov. 19, 2012 (6 pages).

Notification of Transmittal of the International Search Report and the Written Opinion of the International Searching Authority issued in International Application No. PCT/GB2012/000571, date of mailing Nov. 19, 2012 (1 page).

"126 precut zigarettenfilter—Zuschnitte in Cellophan", company website, May 17, 2010, http://www.marijuana.lu/de/126-precut-zigarettenfilter-p-6002.html (1 page).

Search Report issued in United Kingdom Application No. GB1111678.7, dated Sep. 27, 2011 (3 pages).

GroceryTrader, "A smoother, cooler Swan", Jul. 7, 2008, https://grocerytrader.co.uk/a-smoother-cooler-swan (2 pages).

* cited by examiner

TOBACCO SMOKE FILTER AND METHOD OF PRODUCTION

CROSS-REFERENCE TO RELATED APPLICATIONS

This is a divisional of prior U.S. Ser. No. 14/131,293, filed Mar. 27, 2014, which was the National Stage of International Application No. PCT/GB2012/000571, filed Jul. 4, 2012, which claims priority from United Kingdom Application No. 1111678.7, filed Jul. 7, 2011, United Kingdom Application No. 1117418.2, filed Oct. 7, 2011 and United Kingdom Application No. 1118891.9, filed Nov. 1, 2011, all of which are hereby incorporated by reference in their entireties.

FIELD OF THE INVENTION

The present invention relates to tobacco smoke filters or filter elements and methods of their production.

BACKGROUND AND SUMMARY OF THE INVENTION

Non-Wrapped Acetate (NWA) filters are well-known in the art. Typically, NWA filters comprise a self-sustaining body of continuous crimped cellulose acetate filaments bonded at their points of contact. NWA filters are characterized from conventional cigarette filters because the former do not require a separate plugwrap to wrap the filter and hold the fibrous bundle in place with a controlled circumference.

NWA filters may be made manufactured by a process similar to that described in UK Patent No. 1169932 (U.S. Pat. No. 3,455,766). Filaments of cellulose acetate tow to which a plasticiser has been applied are fed into a forming station where a belt is folded around the tow until the longitudinal edges of the belt are juxtaposed and the tow is confined within the belt; the tow is thus formed into a longitudinally extending cylinder by the belt. The belt is then moved to a heat treating station where a heating fluid (e.g. steam) is passed through the belt into contact with the tow to activate the plasticizer. The belt and tow therewithin are then moved through a cooling station where cool air or other fluid is passed through the belt into contact with the tow to deactivate the plasticizer, if necessary, and dry the tow by removal of condensed steam, whereby the tow is made rigid to form a continuous self sustaining and stable longitudinally extending rod. This method has the limitation that it is not possible to add flavouring agent to the filter during filter manufacture because flavourants are inherently volatile and will therefore be entrained and removed with the heating fluid during the manufacturing process. Thus, to date it has not been possible to make flavoured NWA filters on a commercial scale.

The lack of a flavoured NWA filter is not critical for conventional cigarettes because it is possible to add flavouring agent to the final product (e.g. through an additional flavoured filter segment, to the cigarette packaging, or to the tobacco). However, this is a limitation for Roll-Your-Own (RYO) smokers because NWA filters are often used as filters for Roll-Your-Own (RYO cigarettes).

NWA filters can be sold as 'Pop-a-Tip' filters, available from Filtrona Filters. Pop-a-Tip filters comprise a series of NWA filters (filter tips) wrapped in a transparent film e.g. made of BOPP or cellophane. The NWA filters are individually pushed (or 'popped') out of the transparent wrap by smokers of RYO products, who then use the filter when rolling their cigarette. As indicated above, it has hitherto not been possible to produce flavoured (NWA) Pop-a-Tips on a commercial scale. Thus, to provide a flavoured RYO filter, it has previously been necessary for flavoured Pop-a-Tip products to incorporate conventional wrapped acetate filters (i.e. where the cellulose acetate is circumscribed in plugwrap). Such wrapped acetate (WA) filters can be easily flavoured using techniques well-known in the art. However, it is much more difficult to 'pop' a WA filter from the transparent film. Further, WA filters have a less acceptable tactile feel than NWA tips, which is particularly important to RYO smokers who buy loose packed tips rather than Pop-a-Tips. Thus, to date there has not been a flavoured filter tip that is acceptable to the majority of RYO smokers.

There is therefore a need for a flavoured NWA filter product, to meet the requirements of RYO smokers.

Conventional Pop-a-Tip manufacture takes place on a dual rod filter making machine, as is well known in the art. These machines are normally used for combining two different types of base rod, which are held in two different hoppers on the machine. However, for Pop-a-Tip manufacture the two hoppers are filled with the same base rod type and these base rods are cut down (to provide the required tip length), aligned in an end-to-end relationship, wrapped in transparent film and cut to the final required Pop-a-Tip length. Pop-a-Tips are typically supplied in rods of around 17.5 mm circumference and 84 mm length, each containing 6 tips of 14 mm length. Prior to wrapping, the aligned tips pass through a compression shoe which is used to control the final circumference of the finished article.

The applicants have surprisingly found that flavour can be applied to the filters immediately prior to wrapping in the (e.g. transparent) film thereby avoiding problems associated with removal of volatile flavouring agents during manufacture of the NWA filters. The flavour may be applied for example through a modified compression shoe. An additional advantage is that this compression shoe can be simply and quickly changed with a conventional shoe, thereby enabling rapid changes from a mentholated Pop-a-Tip to a standard Pop-a-Tip specification. Such a process modification is unsuitable for applying flavours to wrapped acetate filters because the plugwrap acts as a barrier to the application of flavour solution.

According to the present invention there is provided a method of producing a flavoured tobacco smoke filter or filter element comprising a self-sustaining longitudinally extending cylindrical core comprising (e.g. formed from) fibres or filaments of tobacco smoke filtering material which are bonded at their points of contact; the method comprising a step of applying a flavouring agent to a longitudinally advancing flow of (e.g. individual e.g. pre-formed) filters and/or (e.g. individual e.g. pre-formed) filter elements and/or (e.g. pre-formed) multiple (e.g. dual) filter rods.

Preferably the method includes a further step of applying a wrapper to the continuously advancing flow of filters and/or filter elements and/or multiple filter rods to which the flavouring agent has been applied (to thereby form a continuous wrapped rod comprising filters and/or filter elements and/or multiple filter rods bearing flavouring agent). Preferably the wrapper is a film, e.g. made of BOPP or cellophane. Preferably the wrapper is a transparent film e.g. made of BOPP or cellophane.

Preferably, the method includes a further step of cutting the continuous wrapped rod comprising filters and/or filter elements and/or multiple filter rods (to thereby provide a plurality of individual wrapped rods each comprising one or more filters or filter elements bearing flavouring agent).

Herein the term "multiple filter rod" means a rod [e.g. comprising a self-sustaining longitudinally extending cylindrical core comprising (e.g. formed from) fibres or filaments of tobacco smoke filtering material which are bonded at their points of contact] which may be cut to provide multiple (2, 3, 4, 5 etc.) individual filters (or filter elements). The term "dual filter rod" means a rod [e.g. comprising a self-sustaining longitudinally extending cylindrical core comprising (e.g. formed from) fibres or filaments of tobacco smoke filtering material which are bonded at their points of contact] which may be cut to provide two individual filters (or filter elements).

The (e.g. individual e.g. pre-formed) filters and/or (e.g. individual e.g. pre-formed) filter elements and/or e.g. pre-formed) multiple filter rods in the flow are preferably aligned such that the longitudinally axes of their cylindrical cores are oriented along the longitudinal direction of the flow.

The (e.g. individual e.g. pre-formed) filters and/or (e.g. individual e.g. pre-formed) filter elements and/or (e.g. pre-formed) multiple filter rods in the longitudinally advancing flow may be longitudinally spaced from each other (i.e. each filter/element/rod longitudinally spaced from the next along the flow). The (e.g. individual e.g. pre-formed) filters and/or (e.g. individual e.g. pre-formed) filter elements and/or e.g. (pre-formed) multiple filter rods in the longitudinally advancing flow may be abutted in end to end relationship (i.e. without longitudinal spacing between filters/elements/rods).

The longitudinally advancing flow may comprise pluralities (groups) of (e.g. individual e.g. pre-formed) filters or (e.g. individual e.g. pre-formed) filter elements arranged between (e.g. pre-formed) multiple (e.g. dual) filter rods with the filters/filter elements and filter rods in the longitudinally advancing flow abutted in end to end relationship (i.e. without longitudinal spacing between filters/elements/rods). The method may comprise a subsequent step of applying a wrapper to the continuously advancing flow to thereby form a continuous wrapped rod comprising longitudinally spaced pluralities (groups) of abutted filters or filter elements bearing flavouring agent arranged between (and abutted to) multiple (e.g. dual) filter rods bearing flavouring agent. Preferably, the method then includes a further step of cutting the continuous wrapped rod in register with the (each) multiple (e.g. dual) filter rods such that the multiple (e,g, dual) filter rod is cut into individual filters, to thereby provide a plurality of individual wrapped rods each comprising filters or filter elements bearing flavouring agent.

In a preferred arrangement the longitudinally advancing flow comprises pluralities (groups) of 2, 3, 4 or 5, preferably 4, filters arranged between dual filter rods with the filters and dual filter rods abutted in end to end relationship. The method may then comprise a subsequent step of applying a wrapper to the continuously advancing flow to thereby form a continuous wrapped rod comprising longitudinally spaced pluralities (groups) of abutted filters arranged between (and abutted with) dual filter rods, (with the filters and rods all bearing flavouring agent). Preferably, the method then includes a further step of cutting the continuous wrapped rod in register with (half way along) the (each) dual filter rod such that the dual filter rod is cut into two individual filters, to thereby provide a plurality of individual wrapped rods each comprising filters bearing flavouring agent.

The longitudinally advancing flow may comprise pluralities (groups) of abutted filters or filter elements with each plurality (group) of filters/filter elements longitudinally spaced from the next along the flow (e.g. spaced units comprising a plurality of e.g. 2, 3, 4, 5 or 6 filters or filter elements abutted end to end) In examples of the invention wherein the flow comprises longitudinally spaced pluralities (groups) of abutted filters or filter elements (e.g. units or arrangements each comprising a plurality of e.g. 2, 3, 4, 5 or 6 filters or filter elements abutted end to end), the method may comprise a subsequent step of applying a wrapper to the continuously advancing flow of filters or filter elements to thereby form a continuous wrapped rod comprising longitudinally spaced pluralities (groups) of abutted filters or filter elements bearing flavouring agent (with each plurality (group) of filters/filter elements longitudinally spaced from the next). Preferably, the method then includes a further step of cutting the continuous wrapped rod in register with the spaces between the pluralities of abutted filter or filter elements. In a further preferred example, the cutting step includes a step of crimping and/or at least partially sealing the cut ends of the filter wrap. The crimping or partial sealing advantageously reduces loss of flavouring agent from the product wrapped filters or filter elements.

The flavouring agent is preferably applied in amount of 0.1 and 8, for example 1.5 to 8 milligrams per product filter or filter element. The flavouring agent may be any flavouring agent known for use in tobacco smoke filters or filter elements. For example, the flavouring agent may be menthol, spearmint, peppermint, nutmeg, cinnamon, clove, lemon, chocolate, peach, strawberry, vanilla etc. The agent may contain nicotine or a salt or derivative thereof. Preferably the flavouring agent is menthol. The menthol may be applied as a solution or in the form of molten menthol. Preferably the menthol is applied in amount of 1.5 to 8 milligrams per product filter or filter element. Flavouring agents other than menthol may preferably be applied in an amount of 0.1 to 1.5 mg per product filter or filter element.

The filters or filter elements or multiple filter rods may comprise a self-sustaining longitudinally extending cylindrical core comprising (e.g. formed from) a plurality of longitudinally extending substantially continuous filaments of tobacco smoke filtering material (e.g. cellulose acetate tow) which are bonded at their points of contact. In another example, the filters or filter elements or multiple filter rods may comprise a self-sustaining longitudinally extending cylindrical core comprising (e.g. formed from) a plurality of randomly oriented (e.g. individual or staple) fibres of tobacco smoke filtering material (e.g. cellulose acetate) which are bonded at their points of contact. Preferably the continuous filaments of tobacco smoke filtering material (or randomly oriented fibres of tobacco smoke filtering material) are continuous filaments (or randomly oriented fibres) of cellulose acetate tow. Preferably the tobacco smoke filtering material (e.g. cellulose acetate, cellulose acetate fibres or filaments) is crimped. Preferably the filaments (or fibres) are bonded at their points of contact with a bonding constituent, e.g. a plasticiser (e.g. a plasticiser which has been activated or cured to bond the filaments at their points of contact).

The self-sustaining longitudinally extending cylindrical core may be, for example, a cylindrical rod of circular cross section. The self-sustaining longitudinally extending cylindrical core may be of other shape, for example the self-sustaining longitudinally extending cylindrical core may be of annular cross section such that the self-sustaining longitudinally extending cylindrical core is a longitudinally extending hollow tube comprising (e.g. formed from) fibres or filaments of tobacco smoke filtering material bonded at their points of contact.

The filters and/or filter elements and/or multiple filter rods may further comprise one or more continuous components extending substantially longitudinally (e.g. longitudinally) of the cylindrical core. The (or a, or each) continuous component may be a thread or yarn or tape or continuous extruded element, for example a cotton thread, a cellulose acetate yarn, or a continuous extruded element of e.g. cellulose acetate such as that disclosed in WO2011/058319. Cigarette filters which include a thread or tape element, typically longitudinally aligned therein, are well known in the prior art. They are often referred to as "Thread Filters". Thread Filters were originally proposed in U.S. Pat. No. 4,281,671, in which a cotton sewing thread was the preferred element. U.S. Pat. No. 4,281,671 also disclosed how the thread could be coloured, e.g. with different colours denoting different flavours. U.S. Pat. No. 4,281,671 discloses Thread Filters which require a wrapper around the tobacco smoke filtering material (and thread); it does not disclose filters or filter elements which include a thread but which are self sustaining (i.e. stable, rigid and self-supporting without requirement for a further wrapper).

The (or a, or each) continuous component extending longitudinally of the cylindrical core may be coloured or tinted, e.g. using appropriate dyes or pigments, preferably those with regulatory approval for use in food contact applications. The (or a, or each) continuous component may be of a contrasting colour to the tobacco smoke filtering material. In an example, the (or a, or each) continuous component further comprises a dye or pigment (e.g a dye or pigment which has regulatory approval for use in food contact applications). The dye or pigment may preferably be any colour which contrasts with the (e.g. white) tobacco smoke filtering material, for example green, blue, red, orange etc. If two or more continuous components extending substantially longitudinally (e.g. longitudinally) of the cylindrical core are present, the first continuous component may be of the same colour, or a different colour, to the second continuous component. The use of coloured component(s) (e.g. coloured cotton thread or threads) provides a product filter, element or rod with a distinctive end appearance that is useful for anti-counterfeit purposes.

The continuous component may bear a smoke modifying agent such as a flavouring agent. The flavouring agent may be any flavouring agent known for use in tobacco smoke filters or filter elements. For example, the flavouring agent may be menthol, spearmint, peppermint, nutmeg, cinnamon, clove, lemon, chocolate, peach, strawberry, vanilla etc. The agent may contain nicotine or a salt or derivative thereof. Preferably the flavouring agent is menthol. The flavouring agent may be the same as, or different to, the flavouring agent which is applied to the longitudinally advancing flow of filters and/or filter elements and/or multiple filter rods. It will be appreciated that the method of forming a NWA Thread filter disclosed below (with reference to FIGS. 4 and 5) forms filaments of cellulose tow to which plasticiser has been applied around the continuous element (the thread) and then uses a heating fluid (and optionally cooling) to activate the plasticiser, whereby the filtering rod is made rigid and stable. As set out above, if there is a flavourant located on the continuous element, the inherent volatility of the flavourant will result in its entrainment with the heating fluid during this manufacturing process with subsequent removal of the majority of the flavourant with the fluid, and dispersal of the remainder over the filter element. Thus, it is preferred that the majority of the desired flavourant is applied to the continuously advancing flow of ready formed filters and/or filter elements and/or multiple filter rods, rather than applied to the continuous component (e.g. thread) held therein.

According to the present invention in a further aspect there is provided an apparatus for producing flavoured tobacco smoke filters or filter elements comprising feed means (a feeder) for longitudinally advancing a flow of filters and/or filter elements and/or filter rods each comprising a self-sustaining longitudinally extending cylindrical core comprising fibres or filaments of tobacco smoke filtering material which are bonded at their points of contact; and flavour application means (a flavour applicator) for applying a flavouring agent to the longitudinally advancing filters and/or filter elements and/or multiple filter rods.

According to the present invention in a further aspect there is provided a tobacco smoke filter or filter element comprising a self-sustaining (longitudinally extending) substantially cylindrical core comprising (e.g. formed from) fibres or filaments of tobacco smoke filtering material bonded at their points of contact; and a flavouring agent. Preferably the flavouring agent is located on or in the core. The filter or filter element may comprise a wrapper. Preferably the wrapper is a film, e.g. made of BOPP or cellophane. Preferably the wrapper is a transparent film e.g. made of BOPP or cellophane.

The flavouring agent is preferably applied in amount of 0.1 and 8, for example 1.5 to 8 milligrams per product filter or filter element. The flavouring agent may be any flavouring agent known for use in tobacco smoke filters or filter elements. For example, the flavouring agent may be menthol, spearmint, peppermint, nutmeg, cinnamon, clove, lemon, chocolate, peach, strawberry, vanilla etc. The agent may contain nicotine or a salt or derivative thereof. Preferably the flavouring agent is menthol. The menthol may be applied as a solution or in the form of molten menthol. Preferably the menthol is applied in amount of 1.5 to 8 milligrams per product filter or filter element. Flavouring agents other than menthol may preferably be applied in an amount of 0.1 to 1.5 mg per product filter or filter element.

The filters or filter elements may comprise a self-sustaining (longitudinally extending) cylindrical core comprising (e.g. formed from) a plurality of longitudinally extending substantially continuous filaments of tobacco smoke filtering material (e.g. cellulose acetate tow) which are bonded at their points of contact. In another example, the filters or filter elements may comprise a self-sustaining (longitudinally extending) cylindrical core comprising (e.g. formed from) a plurality of randomly oriented (e.g. individual or staple) fibres of tobacco smoke filtering material (e.g. cellulose acetate) which are bonded at their points of contact. Preferably the continuous filaments of tobacco smoke filtering material (or randomly oriented fibres of tobacco smoke filtering material) are continuous filaments (or randomly oriented fibres) of cellulose acetate tow. Preferably the tobacco smoke filtering material (e.g. cellulose acetate, cellulose acetate fibres or filaments) is crimped. Preferably the filaments (or fibres) are bonded at their points of contact with a bonding constituent, e.g. a plasticiser (e.g. a plasticiser which has been activated or cured to bond the filaments at their points of contact). The self-sustaining longitudinally extending cylindrical core may be, for example, a cylindrical rod of circular cross section. The self-sustaining longitudinally extending cylindrical core may be of other shape, for example the self-sustaining longitudinally extending cylindrical core may be of annular cross section such that the self-sustaining longitudinally extending cylindrical core is a longitudinally extending hollow tube comprising (e.g. formed from) fibres or filaments of tobacco smoke filtering material bonded at their points of contact.

The filter or filter element may further comprise one or more continuous components extending substantially longitudinally (e.g. longitudinally) of the cylindrical core. The (or a, or each) continuous component may be a thread or yarn or tape or continuous extruded element, for example a cotton thread, a cellulose acetate yarn or a continuous extruded element of e.g. cellulose acetate such as that disclosed in WO2011/058319.

The (or a, or each) continuous component extending longitudinally of the cylindrical core may be coloured or tinted, e.g. using appropriate dyes or pigments, preferably those with regulatory approval for use in food contact applications. The (or a, or each) continuous component may be of a contrasting colour to the tobacco smoke filtering material. In an example, the (or a, or each) continuous component further comprises a dye or pigment (e.g a dye or pigment which has regulatory approval for use in food contact applications). The dye or pigment may preferably be any colour which contrasts with the (e.g. white) tobacco smoke filtering material, for example green, blue, red, orange etc. If two or more continuous components extending substantially longitudinally (e.g. longitudinally) of the cylindrical core are present, the first continuous component may be of the same colour, or a different colour, to the second continuous component. The use of coloured component(s) (e.g. coloured cotton thread or threads) provides a product filter or filter element with a distinctive end appearance that is useful for anti-counterfeit purposes.

The continuous component may bear a smoke modifying agent such as a flavouring agent. The flavouring agent may be any flavouring agent known for use in tobacco smoke filters or filter elements. For example, the flavouring agent may be menthol, spearmint, peppermint, nutmeg, cinnamon, clove, lemon, chocolate, peach, strawberry, vanilla etc. The agent may contain nicotine or a salt or derivative thereof. Preferably the flavouring agent is menthol. The flavouring agent on the continuous component may be the same as, or different to, the other flavouring agent on the filters or filter elements.

According to the present invention in a still further aspect there is provided a product comprising a plurality of individual tobacco smoke filters or filter elements abutted end to end, each filter or filter element including a self-sustaining substantially cylindrical core comprising (e.g. formed from) fibres or filaments of tobacco smoke filtering material bonded at their points of contact and a flavouring agent; and a wrapper around the plurality of individual tobacco smoke filters or filter elements. Preferably the flavouring agent is located on or in the core of each filter/filter element. Preferably the wrapper is a film, e.g. made of BOPP or cellophane. Preferably the wrapper is a transparent film e.g. made of BOPP or cellophane.

In a further example, the wrapper extends longitudinally at each end beyond the abutted plurality of individual tobacco smoke filters or filter elements and is sealed or partially sealed (e.g. by crimping). The crimping or partial sealing advantageously reduces loss of flavouring agent from the product wrapped filters or filter elements.

The flavouring agent is preferably applied in amount of 0.1 and 8, for example 1.5 to 8 milligrams per product filter or filter element. The flavouring agent may be any flavouring agent known for use in tobacco smoke filters or filter elements. For example, the flavouring agent may be menthol, spearmint, peppermint, nutmeg, cinnamon, clove, lemon, chocolate, peach, strawberry, vanilla etc. The agent may contain nicotine or a salt or derivative thereof. Preferably the flavouring agent is menthol. The menthol may be applied as a solution or in the form of molten menthol. Preferably the menthol is applied in amount of 1.5 to 8 milligrams per product filter or filter element. Flavouring agents other than menthol may preferably be applied in an amount of 0.1 to 1.5 mg per product filter or filter element.

The product may include filters or filter elements which further comprise one or more continuous components extending substantially longitudinally (e.g. longitudinally) of the cylindrical core. The (or a, or each) continuous component may be a thread or yarn or tape or continuous extruded element, for example a cotton thread, a cellulose acetate yarn or a continuous extruded element of e.g. cellulose acetate such as that disclosed in WO2011/058319.

The (or a, or each) continuous component extending longitudinally of the cylindrical core may be coloured or tinted, e.g. using appropriate dye or pigments, preferably those with regulatory approval for use in food contact applications. The (or a, or each) continuous component may be of a contrasting colour to the tobacco smoke filtering material. In an example, the (or a, or each) continuous component further comprises a dye or pigment (e.g a dye or pigment which has regulatory approval for use in food contact applications). The dye or pigment may preferably be any colour which contrasts with the (e.g. white) tobacco smoke filtering material, for example green, blue, red, orange etc. If two or more continuous components extending substantially longitudinally (e.g. longitudinally) of the cylindrical core are present, the first continuous component may be of the same colour, or a different colour, to the second continuous component. The use of coloured component(s) (e.g. coloured cotton thread or threads) provides a product filter or filter element with a distinctive end appearance that is useful for anti-counterfeit purposes.

The continuous component may bear a smoke modifying agent such as a flavouring agent. The flavouring agent may be any flavouring agent known for use in tobacco smoke filters or filter elements. For example, the flavouring agent may be menthol, spearmint, peppermint, nutmeg, cinnamon, clove, lemon, chocolate, peach, strawberry, vanilla etc. The agent may contain nicotine or a salt or derivative thereof. Preferably the flavouring agent is menthol. The flavouring agent on the continuous component may be the same as, or different to, the other flavouring agent on the filters or filter elements.

It was expected that mentholated "Pop-a-Tip" products according to the invention would be more difficult to 'pop' than the equivalent non-mentholated tips because the presence of tiny menthol crystals on the surface of the filter (after menthol application) would increase frictional forces within the transparent wrap. Surprisingly, the applicants have found that there is no discernable difference between the 'ease of popping' of the product of the invention and the prior art non-mentholated "Pop-a-Tip" products. Further, it has been found to be significantly easier to 'pop' a product of the invention than an equivalent mentholated WA filter—in this latter case, there was a tendency to crush and deform both the wrapper and the filter whilst attempting to push it out, rendering it unsuitable for filter use. The applicants have surprisingly found that menthol may be applied to tips of 14 mm length×17.5 mm circumference at loadings of up to 8 mg/tip with no discernable impact of ease of popping.

The filters or filter elements may comprise a self-sustaining (longitudinally extending) cylindrical core comprising (e.g. formed from) a plurality of longitudinally extending substantially continuous filaments of tobacco smoke filtering material (e.g. cellulose acetate tow) which are bonded at their points of contact. In another example, the filters or filter elements may comprise a self-sustaining (longitudinally extending) cylindrical core comprising (e.g. formed from) a plurality of randomly oriented (e.g. individual or staple) fibres of tobacco smoke filtering material (e.g. cellulose acetate) which are bonded at their points of contact. Preferably the continuous filaments of tobacco smoke filtering material (or randomly oriented fibres of tobacco smoke filtering material) are continuous filaments (or randomly oriented fibres) of cellulose acetate tow. Preferably the tobacco smoke filtering material (e.g. cellulose acetate, cellulose acetate fibres or filaments) is crimped. Preferably the filaments (or fibres) are bonded at their points of contact with a bonding constituent, e.g. a plasticiser (e.g. a plasticiser which has been activated or cured to bond the filaments at their points of contact). The self-sustaining longitudinally extending cylindrical core may be, for example, a cylindrical rod of circular cross section. The self-sustaining longitudinally extending cylindrical core may be of other shape, for example the self-sustaining longitudinally extending cylindrical core may be of annular cross section such that the self-sustaining longitudinally extending cylindrical core is a longitudinally extending hollow tube comprising (e.g. formed from) fibres or filaments of tobacco smoke filtering material bonded at their points of contact.

Herein, the term "self-sustaining" (as in "self-sustaining substantially cylindrical core", "self-sustaining longitudinally extending substantially cylindrical core" etc.) means stable, rigid and self-supporting without requirement for a further wrapper (of e.g. plugwrap) to maintain its shape (e.g without requirement for a wrapper to hold the longitudinally extending continuous filaments in alignment to control the radius or circumference of the core).

The tobacco smoke filter or filter element according to the invention (or in methods or products according to the invention) may be of circumference 14 to 28 mm, for example 16 to 26 mm, for example 16 to 19 mm (e.g. 17.5 mm) or 24 to 25 mm. A tobacco smoke filter of the invention may be of length 10 to 40 mm, e.g. 11 to 25 mm, e.g. 12 to 16 mm, e.g. 14 mm. A tobacco smoke filter element of the invention may be of length 5 to 30 mm, e.g. 6 to 20 mm, e.g. 8 to 15 mm, e.g. 10 to 12 mm.

Filters and filter elements according to the invention may be used in machine made cigarettes (e.g. those mass produced and packaged). Filters and filter elements according to the invention may also be used as (or in) a filter tip for use with a individually rolled cigarette (e.g. a hand rolled cigarette) or a Roll Your Own or Make-Your-Own product.

It will be appreciated that as well as being suitable for making a product comprising a wrapped plurality of (individual) tobacco smoke filters abutted end to end (e.g. a 'Pop-a-Tip' type product), methods and apparatus according to the invention are suitable for making individual flavoured filters (e.g. flavoured NWA filters) which may be packaged loose in bags and boxes as is also known in the art.

A filter element according to the invention may also be used as the mouth-end segment of a multi-segment filter, e.g. a dual, triple, other multiple filter. Such filters are well known in the art.

According to the present invention in a still further aspect there is provided a tobacco smoke filter or filter element comprising a self-sustaining (longitudinally extending) substantially cylindrical core comprising (e.g. formed from) fibres or filaments of tobacco smoke filtering material bonded at their points of contact; one or more continuous components extending substantially longitudinally (e.g. longitudinally) of the cylindrical core; and a flavouring agent.

Preferably the flavouring agent is located on or in the core. The flavouring agent may be located (at least partially located) on the (or a, or each) continuous component. The flavouring agent is preferably included in amount of 0.1 and 8, for example 1.5 to 8 milligrams per product filter or filter element.

The flavouring agent may be any flavouring agent known for use in tobacco smoke filters or filter elements. For example, the flavouring agent may be menthol, spearmint, peppermint, nutmeg, cinnamon, clove, lemon, chocolate, peach, strawberry, vanilla etc. The agent may contain nicotine or a salt or derivative thereof.

Preferably the flavouring agent is menthol. The menthol may be applied as a solution or in the form of molten menthol. Preferably the menthol is applied in amount of 1.5 to 8 milligrams per product filter or filter element. Flavouring agents other than menthol may preferably be applied in an amount of 0.1 to 1.5 mg per product filter or filter element.

The (or a, or each) continuous component may be a thread or yarn or tape or continuous extruded element, for example a cotton thread, a cellulose acetate yarn or a continuous extruded element of e.g. cellulose acetate such as that disclosed in WO2011/058319.

The filter or filter element may further comprise a wrapper.

The (or a, or each) continuous component extending longitudinally of the cylindrical core may be coloured or tinted, e.g. using appropriate dyes or pigments, preferably those with regulatory approval for use in food contact applications. The (or a, or each) continuous component may be of a contrasting colour to the tobacco smoke filtering material. In an example, the (or a, or each) continuous component further comprises a dye or pigment (e.g a dye or pigment which has regulatory approval for use in food contact applications). The dye or pigment may preferably be any colour which contrasts with the (e.g. white) tobacco smoke filtering material, for example green, blue, red, orange etc. If two or more continuous components extending substantially longitudinally (e.g. longitudinally) of the cylindrical core are present, the first continuous component may be of the same colour, or a different colour, to the second continuous component. The use of coloured component(s) (e.g. coloured cotton thread or threads) provides a product filter or filter element with a distinctive end appearance that is useful for anti-counterfeit purposes.

The filters or filter elements may comprise a self-sustaining (longitudinally extending) cylindrical core comprising (e.g. formed from) a plurality of longitudinally extending substantially continuous filaments of tobacco smoke filtering material (e.g. cellulose acetate tow) which are bonded at their points of contact. In another example, the filters or filter elements may comprise a self-sustaining (longitudinally extending) cylindrical core comprising (e.g. formed from) a plurality of randomly oriented (e.g. individual or staple) fibres of tobacco smoke filtering material (e.g. cellulose acetate) which are bonded at their points of contact. Preferably the continuous filaments of tobacco smoke filtering material (or randomly oriented fibres of tobacco smoke filtering material) are continuous filaments (or randomly oriented fibres) of cellulose acetate tow. Preferably the tobacco smoke filtering material (e.g. cellulose acetate, cellulose acetate fibres or filaments) is crimped. Preferably the filaments (or fibres) are bonded at their points of contact with a bonding constituent, e.g. a plasticiser (e.g. a plasticiser which has been activated or cured to bond the filaments at their points of contact). The self-sustaining longitudinally extending cylindrical core may be, for example, a cylindrical rod of circular cross section. The tobacco smoke filter or filter element may be of circumference 14 to 28 mm, for example 16 to 26 mm, for example 16 to 19 mm (e.g. 17.5 mm) or 24 to 25 mm. A tobacco smoke filter of the invention may be of length 10 to 40 mm, e.g. 11 to 25 mm, e.g. 12 to 16 mm, e.g. 14 mm. A tobacco smoke filter element of the invention may be of length 5 to 30 mm, e.g. 6 to 20 mm, e.g. 8 to 15 mm, e.g. 10 to 12 mm.

As discussed above, "Thread Filters", cigarette filters which include a thread or tape element, typically longitudinally aligned therein, are well known in the prior art. Thread Filters were originally proposed in U.S. Pat. No. 4,281,671, in which a cotton sewing thread was the preferred element. However, U.S. Pat. No. 4,281,671 discloses Thread Filters which require a wrapper around the tobacco smoke filtering material (and thread); it does not disclose filters or filter elements which include a thread but which are self sustaining (i.e. stable, rigid and self-supporting without requirement for a further wrapper). This aspect of the present invention provides self sustaining (and flavour bearing) Thread Filters or filter elements, which may be used in machine made cigarettes as well as individually rolled cigarettes (e.g. a hand rolled cigarette) or a Roll Your Own or Make-Your-Own products. A filter element according to this aspect of the invention may also be used as a segment, e.g. the mouth-end segment, of a multi-segment filter, e.g. a dual, triple, other multiple filter.

It will be appreciated that the method of forming a NWA Thread filter disclosed below (with reference to FIGS. 4 and 5) forms filaments of cellulose tow to which plasticiser has been applied around the continuous element (the thread) and then uses a heating fluid (and optionally cooling) to activate the plasticiser, whereby the filtering rod is made rigid and stable. As set out above, if there is a flavourant located on the continuous element, the inherent volatility of the flavourant will result in its entrainment with the heating fluid during this manufacturing process with subsequent removal of the majority of the flavourant with the fluid, and dispersal of the remainder over the filter element. Thus, it is preferred that the majority of the desired flavourant is applied to the continuously advancing flow of ready formed filters and/or filter elements and/or multiple filter rods, rather than applied to the continuous component (e.g. thread) held therein (as described below with reference to FIGS. 3 and 5). However, it will also be appreciated that filters and filter elements according to the invention, especially this aspect of the invention, may also be made by forming filaments of cellulose tow (to which plasticiser has been applied) around a continuous element bearing a flavouring agent; and then using a heating fluid (and optionally cooling) to activate the plasticiser, whereby the filtering rod is made rigid and stable. It will be appreciated that this method of manufacture does not require application of flavouring agent to the filtering rod after it has been made rigid and stable, because the flavouring agent will be dispersed over the continuous element and the remainder of the filter element. However, this method, although simpler, may not be preferred where high loadings of flavouring agent are required, because flavouring agent is lost during manufacture (due to its inherent volatility).

The invention includes any filter cigarette made using a filter according to the invention.

BRIEF DESCRIPTION OF THE DRAWINGS

The present invention will now be illustrated with reference to the following Examples and the attached drawings in which FIG. 1 schematically illustrates a product rod of filters according to an embodiment of the invention;

FIG. 1 or 2;

DETAILED DESCRIPTION

Figure 1:
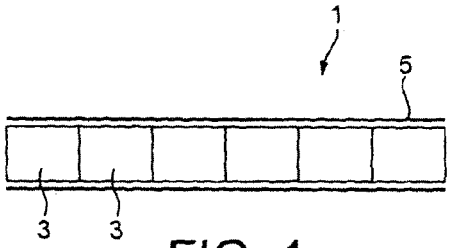

FIG. 1 shows a flavoured NWA "Pop-a-tip" product 1 according to one embodiment of the invention.

The product 1 comprises a plurality of six tobacco smoke filters 3 each of around 17.5 mm circumference and length 14 mm abutted end to end. Each filter 3 includes a self-sustaining substantially cylindrical core formed from a plurality of longitudinally extending substantially continuous filaments of crimped cellulose acetate tow which are bonded at their points of contact (i.e. each filter 3 is a NWA filter), to which menthol flavouring agent has been applied in an amount of 6 mg per filter (see method below). The product 1 also includes a wrapper 5 comprising a transparent film made of BOPP or cellophane which surrounds the filters 3 thereby forming a wrapped cylinder of six filter elements.

In use the smoker takes product 1 and pushes or pops a filter 3 individually out of the transparent wrap; the filter is then used when rolling a RYO cigarette. It was expected that mentholated "Pop-a-Tip" products according to the invention would be more difficult to 'pop' than the equivalent non-mentholated tips because the presence of tiny menthol crystals on the surface of the filter (after menthol application) would increase frictional forces within the transparent wrap. Surprisingly, the applicants have found that there is no discernable difference between the 'ease of popping' of the product of the invention and the prior art non-mentholated "Pop-a-Tip" products.

Figure 2:
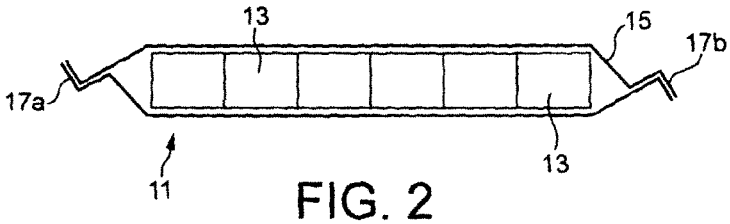
FIG. 2 schematically illustrates a product rod of filters according to a further embodiment of the invention.

FIG. 2 shows a flavoured NWA "Pop-a-tip" product 11 according to a further embodiment of the invention. The product 11 comprises a plurality of six tobacco smoke filters 13 each of around 17.5 mm circumference and length 14 mm abutted end to end. Each filter 13 includes a self-sustaining substantially cylindrical core formed from a plurality of longitudinally extending substantially continuous filaments of crimped cellulose acetate tow which are bonded at their points of contact (i.e. each filter 13 is a NWA filter), to which menthol flavouring agent has been applied in an amount of 4 mg per filter (see method below). The product 13 also includes a wrapper 15 comprising a transparent film made of BOPP or cellophane which surrounds the filters 13 thereby forming a wrapped cylinder of six filter elements 13. As can be seen in FIG. 2 the wrapper extends longitudinally at each end 17*a*, 17*b* of the cylinder beyond the abutted plurality of individual tobacco smoke filters or filter elements and is sealed (or partially sealed) by crimping. The crimping advantageously reduces loss of flavouring agent from the product wrapped filters or filter elements prior to use. The method of use of product 11 is similar to that of product 1; the user simply pushes or pops a filter 13 individually out of the transparent wrap. As will be understood, the first filter which is popped from the product may either be popped through the crimped end (17*a* or 17*b*) of the product, or the crimped end may be torn or cut away prior to popping the filter out.

It will be appreciated that in further embodiments of the invention, the filters 3, 13 in the above examples could instead be replaced with filters comprising a self-sustaining (longitudinally extending) cylindrical core formed from a plurality of randomly oriented individual or staple fibres of tobacco smoke filtering material (e.g. cellulose acetate tow) which are bonded at their points of contact, for example as disclosed in U.S. Pat. No. 3,552,400. The flavouring agent would be applied in a similar way (see below).

Figure 3:
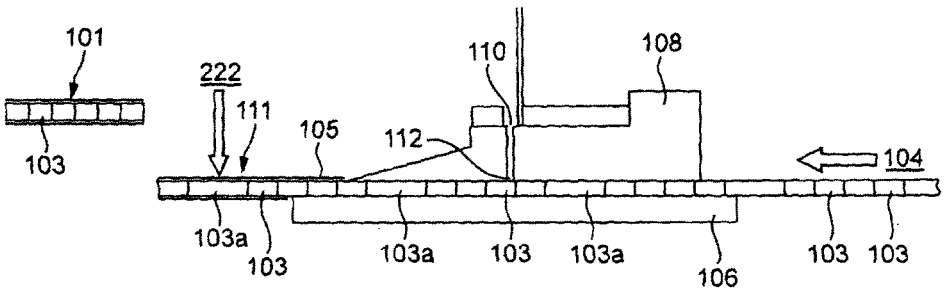
FIG. 3 schematically illustrates a method and apparatus according to further embodiments of the invention which may be used to manufacture the product of e.g.

FIG. 3 shows a method and apparatus according to a further embodiment of the invention which may be used to manufacture the product of FIG. 1.

As can be seen in FIG. 3 a flow of pre-formed filters 103 and pre-formed dual filter rods 103*a* is longitudinally advanced in the direction of arrow 104 into a garniture unit 106.

The pre-formed filters 103 are each of around 17.5 mm circumference and length 14 mm. Each filter 103 includes a self-sustaining substantially cylindrical core formed from a plurality of longitudinally extending substantially continuous filaments of crimped cellulose acetate tow which are bonded at their points of contact. The pre-formed dual filter rods 103*a* are each of around 17.5 mm circumference and length 28 mm. Each rod 103*a* includes a self-sustaining substantially cylindrical core formed from a plurality of longitudinally extending substantially continuous filaments of crimped cellulose acetate tow which are bonded at their points of contact. The filters 103 are NWA filters and may, as well as dual rods 103 *a*, be manufactured by a process similar to that described in UK Patent No. 1169932 (U.S. Pat. No. 3,455,766), in which filaments of cellulose acetate tow to which a plasticiser has been applied are fed into a forming station where a belt is folded around the tow until the longitudinal edges of the belt are juxtaposed and the tow is confined within the belt; the tow is thus formed into a longitudinally extending cylinder by the belt. The belt is then moved to a heat treating station where a heating fluid (e.g. steam) is passed through the belt into contact with the tow to activate the plasticizer. The belt and tow therewithin are then moved through a cooling station where cool air or other fluid is passed through the belt into contact with the tow to deactivate the plasticizer, if necessary, and dry the tow by removal of condensed steam, whereby the tow is made rigid to form a continuous self sustaining and stable longitudinally extending rod. The continuous self sustaining and stable longitudinally extending rod is cut into base rods of filters for subsequent use also by methods well known in the art.

As indicated above, conventional Pop-a-Tip manufacture takes place on a dual rod filter making machine. These machines are well known in the art and normally used for combining two different types of base rod, which are held in two different hoppers on the machine. For Pop-a-Tip manufacture the two hoppers are filled with the same base rod type and these base rods are cut down (to provide the required tip length), aligned in an end-to-end relationship, wrapped in transparent film and cut to the final required Pop-a-Tip length. In the process of the present invention the two hoppers of the dual rod filter making machine (not shown) are also filled with base rods of filters 103 manufactured as set out above. One hopper is used to cut down the base rods to individual filters 103 of the required tip length (14 mm) and the other hopper is used to cut down the base rods to dual filter rods 103*a* of the required tip length (28 mm) and the dual rod machine is then set to arrange and align the filters 103 and dual filter rods 103*a* in an end-to-end relationship such that each dual filter rod 103 is separated form the next rod 103*a* by four individual filters 103 to provide the flow of pre-formed filters 103 and multiple (dual) filter rods 103*a*. As can be seen In FIG. 3 the filters 103 are aligned and abutted end to end (i.e. there are no spaces between individual filters 103 or filters 103 and filter rods 103*a*) prior to longitudinal advancement in the direction of arrow 104 into the garniture unit 106.

The garniture unit 106 includes a compression shoe 108 through which the aligned and abutted filters 103 and dual filter rods 103*a* are passed prior to wrapping in the garniture. Compression shoes are known in the art for control of the final circumference of the finished rod, but novel compression shoe 108 includes flavor applicator inlet 110 and outlet 112 (in other examples the inlet may feed more than one outlet). A flavouring agent in the form of a menthol solution is pumped under pressure through compression shoe 108 via inlet 110 and outlet 112 to apply menthol to the aligned and abutted filters 103 and filter rods 103*a* as they are advanced longitudinally through the shoe 108 and garniture 106.

The flow of flavouring agent is controlled by methods known in the art such that the desired flavor loading (e.g. 6 mg menthol per filter 103, 12 mg per filter rod 103*a*) is achieved. The applicants have surprisingly found that flavour can be applied to the filters immediately prior to wrapping in the (e.g. transparent) film thereby avoiding problems associated with removal of volatile flavouring agents during manufacture of the filters.

A transparent cellophane wrapper 105 is applied to the continuously advancing flow of filters or filter elements to which the flavouring agent has been applied in the garniture 106 in the conventional manner, to thereby form a continuous wrapped rod 111 comprising groups of four filters 103 bearing flavouring agent separated by dual flavour agent bearing filter rods 103*a*. The continuous wrapped rod 111 is then cut in register with a position half way along each dual filter rod 103*a* (see arrow 222) by methods known in the art to provide products 101 each comprising a plurality of filters 103 in a common cellophane wrapper, for example such as those illustrated in FIG. 1.

It will be appreciated that a product as shown in FIG. 2 may be made by modification of the method of FIG. 3. The settings of the dual rod maker are adjusted to provide a longitudinally advancing flow comprising pluralities of abutted filters 103 with each plurality of filters longitudinally spaced from the next along the flow. The wrapper is then applied to the continuously advancing flow (after menthol application) to form a continuous wrapped rod comprising longitudinally spaced pluralities of abutted filters bearing flavouring agent. The continuous wrapped rod is then cut in register with the spaces between the pluralities of abutted filter or filter elements and the cut ends of the wrapper crimped and/or otherwise at least partially sealed.

Figure 4:
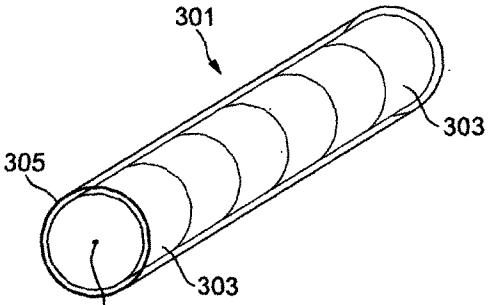
FIG. 4 illustrates a product rod of filters according to a further embodiment of the invention.

FIG. 4 shows a flavoured NWA Flavour Thread "Pop-a-tip" product 301 according to one embodiment of the invention.

The product 301 comprises a plurality of six tobacco smoke filters 303 each of around 17.5 mm circumference and length 14 mm abutted end to end. Each filter 303 includes a self-sustaining substantially cylindrical core formed from a plurality of longitudinally extending substantially continuous filaments of crimped cellulose acetate tow which are bonded at their points of contact, and a continuous component in the form of a green cotton thread 307 which extends longitudinally of the cylindrical core (i.e. each filter 303 is a NWA filter which includes a thread). Menthol flavouring agent has been applied in an amount of 6 mg per filter to each filter 303, by the method described above with reference to FIG. 3. The product 301 also includes a wrapper 305 comprising a transparent film made of BOPP or cellophane which surrounds the filters 303 thereby forming a wrapped cylinder of six filter elements.

In use the smoker takes product 301 and pushes or pops a filter 303 individually out of the transparent wrap; the filter is then used when rolling a RYO cigarette. Surprisingly, as with the embodiment of FIGS. 1 and 2, the applicants have found that there is no discernable difference between the 'ease of popping' of the product of the invention and the prior art non-mentholated "Pop-a-Tip" products. Further, it will be appreciated that the green thread 307 visible at each end of filter 303 provides a distinctive end appearance which is useful as e.g. an indicator that the filter tip is flavoured and/or for anti-counterfeiting measures.

Figure 5:
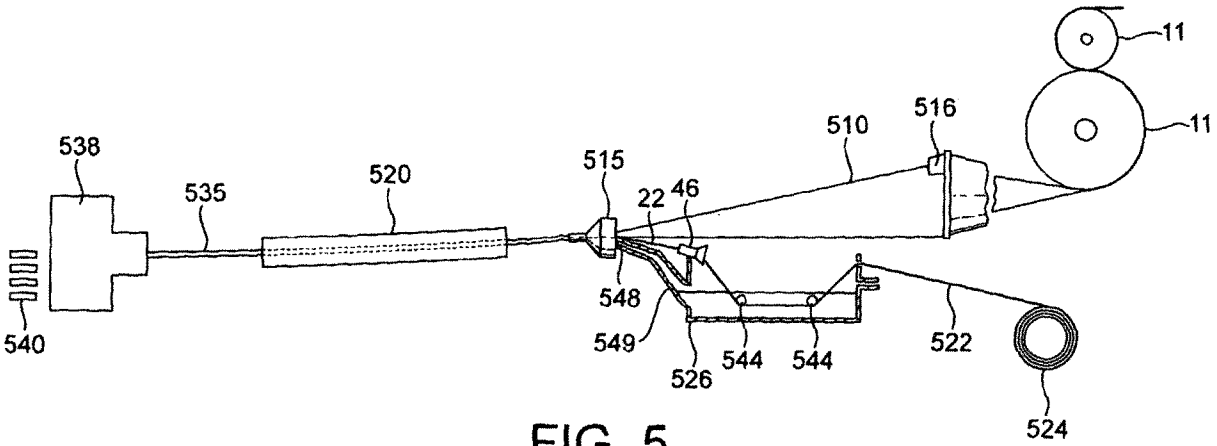
FIG. 5 is a schematic side elevation view of an example of an apparatus used for forming the filter of FIG. 4.

FIG. 5 shows a schematic side elevation view of an apparatus for forming filters 301 of the invention according to FIG. 4. The apparatus is well known in the art. A band of cellulose acetate tow 510 to which plasticiser has been applied (application of plasticiser not shown) is drawn over an upwardly convex bowed bar 516 upstream of a ring or funnel 515. The bar 516 shapes the tow 510 reaching funnel 515 into a downwardly concave arch into which is positioned thread guide mandrel 548. The tow passes through funnel 515, which has an internal wall converging downstream, and is further gathered and condensed into rod form as it enters and passes through a rod forming station 520. A continuous component in the form of (optionally dyed e.g. green) cotton thread 522 is drawn continuously from a reel 524 (optionally, if flavour is desired, through a flavouring agent, e.g. menthol, applicator 526). The thread 522 is drawn from reel 524, optionally flavoured, and led directly into engagement with the tow by means of the thread guide mandrel 548 at a region just upstream of funnel or ring 515, and travels with the tow to and through the rod forming station 520, to become incorporated in and extend the length of the rod produced. On start up of the apparatus, the tow is threaded through the machine into the rod forming station 520, and the free end of thread 522 is stuck to the tow upstream of funnel or ring 515; once the apparatus has been started, the advancing tow continuously entrains the thread 522 and draws it continuously from reel 524 via guide mandrel 548. The cellulose acetate tow to which a plasticiser has been applied is fed, together with the entrained thread 522, into the rod forming station 520 where a belt is folded around the tow until the longitudinal edges of the belt are juxtaposed and the tow is confined within the belt; the tow is thus formed by the belt into a longitudinally extending cylinder enclosing the thread 522. The belt is then moved to a heat treating station where a heating fluid (e.g. steam) is passed through the belt into contact with the tow to activate the plasticizer. The belt and tow therewithin are then moved through a cooling station where cool air or other fluid is passed through the belt into contact with the tow to deactivate the plasticizer, if necessary, and dry the tow by removal of condensed steam, whereby the tow is made rigid to form a continuous self sustaining and stable longitudinally extending rod 536. The continuously produced rod 536 passes to a cutter 538 which severs the rod 536 into individual lengths 540 each of which includes a continuous self-sustaining longitudinally extending cylindrical core comprising a plurality of longitudinally extending substantially continuous filaments of tobacco smoke filtering material (the cellulose acetate) which are bonded at their points of contact surrounding a continuous component (the thread) extending longitudinally of the core. The lengths 540 may be single filter or filter elements, but, more usually, will be multiple double or higher multiple filter rods (usually quadruple or sextuple) lengths for subsequent use, as is well known. The above apparatus is well known and similar to that discussed in, for example, U.S. Pat. No. 4,281,671.

It will be appreciated that the lengths 540 may be used to make a product as shown in FIG. 1, using a modification of the method of FIG. 3. The two hoppers of a dual rod filter making machine (not shown) are filled with base rods of filters 303 manufactured as set out above. One hopper is used to cut down the base rods to individual filters 303 of the required tip length (14 mm) and the other hopper is used to cut down the base rods to dual filter rods 303*a* of the required tip length (28 mm) and the dual rod machine is then set to arrange and align the filters 303 and dual filter rods 303*a* in an end-to-end relationship such that each dual filter rod 303 is separated form the next rod 303*a* by four individual filters 303 to provide the flow of pre-formed filters 303 and multiple (dual) filter rods 303*a*. The filters 303 are aligned and abutted end to end (i.e. there are no spaces between individual filters 303 or filters 303 and filter rods 303*a*) prior to longitudinal advancement into a garniture unit, for example a garniture unit as shown in FIG. 3.

The garniture unit 106 includes a compression shoe 108 through which the aligned and abutted filters 303 and dual filter rods 303*a* are passed prior to wrapping in the garniture. A flavouring agent in the form of a menthol solution is pumped under pressure through compression shoe (as in FIG. 3) to apply menthol to the aligned and abutted filters 303 and filter rods 303*a* as they are advanced longitudinally through the shoe and garniture. A transparent cellophane wrapper is applied to the continuously advancing flow of filters or filter elements to which the flavouring agent has been applied in the garniture in the conventional manner, to thereby form a continuous wrapped rod comprising groups of four filters 303 bearing flavouring agent separated by dual flavour agent bearing filter rods 303*a*. The continuous wrapped rod is then cut in register with a position half way along each dual filter rod 303*a* by methods known in the art to provide products 301 each comprising a plurality of filters 303 in a common cellophane wrapper, for example such as those illustrated in FIG. 4.

It will also be appreciated that filters and filter elements according to some embodiments of the invention may be made by forming filaments of cellulose tow (to which plasticiser has been applied) around a continuous element bearing a flavouring agent; and then using a heating fluid (and optionally cooling) to activate the plasticiser, whereby the filtering rod is made rigid and stable. In other words, filters and filter elements according to some embodiments of the invention may be made using the apparatus of FIG. 5, wherein the flavouring agent is applied only using the flavouring agent, e.g. menthol, applicator 526. It will be appreciated that this method of manufacture does not require application of flavouring agent to the filtering rod after it has been made rigid and stable, because the flavouring agent will be dispersed over the continuous element and the remainder of the filter element. However, this method, although simpler, may not be preferred where high loadings of flavouring agent are required, because flavouring agent is lost during manufacture (due to its inherent volatility).

The invention claimed is:

1. A method of producing a flavoured tobacco smoke filter or filter element comprising a plurality of individual tobacco smoke filters or filter elements abutted end to end, each filter or filter element including a self-sustaining longitudinally extending cylindrical core comprising fibres or filaments of tobacco smoke filtering material bonded at their points of contact and a flavouring agent; and a wrapper around the plurality of individual tobacco smoke filters or filter elements; the method comprising a step of applying the flavouring agent to a longitudinally advancing flow of preformed multiple filter rods immediately prior to wrapping.

2. The method according to claim 1 wherein the wrapper extends longitudinally at each end beyond the abutted plurality of individual tobacco smoke filters or filter elements and is sealed or partially sealed.

3. The method according to claim 2 wherein the flavouring agent is applied in amount of between 0.1 and 8 milligrams per filter or filter element.

4. The method according to claim 3 wherein the tobacco smoke filtering material is cellulose acetate tow.

5. The method according to claim 4 wherein the wrapper is transparent.

6. The method according to claim 3 wherein the wrapper is transparent.

7. The method according to claim 2 wherein the tobacco smoke filtering material is cellulose acetate tow.

8. The method according to claim 7 wherein the wrapper is transparent.

9. The method according to claim 2 wherein the wrapper is transparent.

10. The method according to claim 1 wherein the flavouring agent is applied in amount of between 0.1 and 8 milligrams per filter or filter element.

11. The method according to claim 10 wherein the tobacco smoke filtering material is cellulose acetate tow.

12. The method according to claim 11 wherein the wrapper is transparent.

13. The method according to claim 10 wherein the wrapper is transparent.

14. The method according to claim 1 wherein the tobacco smoke filtering material is cellulose acetate tow.

15. The method according to claim 14 wherein the wrapper is transparent.

16. The method according to claim 1 wherein the wrapper is transparent.

* * * * *